US007607959B2

(12) United States Patent
DeMint

(10) Patent No.: US 7,607,959 B2
(45) Date of Patent: Oct. 27, 2009

(54) PERSONAL WATER CRAFT TO ENABLE A USER TO WALK ON WATER

(76) Inventor: James Warren DeMint, 132 Coventry Rd., Greenville, SC (US) 29615

( * ) Notice: Subject to any disclaimer, the term of this patent is extended or adjusted under 35 U.S.C. 154(b) by 0 days.

(21) Appl. No.: 11/757,538

(22) Filed: Jun. 4, 2007

(65) Prior Publication Data

US 2008/0299851 A1 Dec. 4, 2008

(51) Int. Cl.
*B63B 35/81* (2006.01)

(52) U.S. Cl. ..... 441/76; 440/21

(58) Field of Classification Search ..... 440/21; 441/65, 75, 76, 77

See application file for complete search history.

(56) References Cited

U.S. PATENT DOCUMENTS 3,084,356 A * 4/1963 Wheat ..... 441/77
3,121,892 A * 2/1964 Plumlee ..... 441/77
4,129,912 A 12/1978 Robinson
4,591,343 A * 5/1986 Schaumann ..... 441/76
4,804,345 A * 2/1989 Lee ..... 440/21
4,897,062 A * 1/1990 Watson ..... 440/101
4,915,659 A 4/1990 Sanders
5,080,621 A 1/1992 Nayes
5,120,249 A 6/1992 Fonda
5,616,060 A * 4/1997 Morin ..... 441/76
6,595,813 B1 * 7/2003 Lekhtman ..... 440/21
6,764,363 B2 7/2004 Rosen
7,361,071 B1 * 4/2008 Lauren ..... 441/76

* cited by examiner

*Primary Examiner*—Lars A Olson
(74) *Attorney, Agent, or Firm*—MH2 Technology Law Group LLP

(57) ABSTRACT

A water craft allows a user to travel across a surface of water utilizing a natural walking motion, which employs arms and legs for propulsion similar to cross-country snow skiing. The water craft includes a pair of skis adapted to fit on the user's feet. The skis can be coupled together by semi-elastic tethers. Each ski can include a foot well for receiving the user's foot. The foot well is designed to simulate the natural walking motion of the user. The user can propel the water craft using tail paddles and ski poles. The tail paddles are coupled to the rear of the skis. The tail paddles are configured to float on the water and to rotate about a transverse axis of the skis. The tail paddles are shaped to grip or "dig in" the water in response to the user moving the skis in a direction opposite the direction of motion of the water craft. The tail paddles provide resistance to propel the water craft when the ski is moved backward and slide along the water when the skis move forward. The ski poles include a paddle shaped to grip or "dig in" in response to the user pushing backwards on the ski poles. The paddle provides resistance to the backwards motion to propel the water craft forward. When the user pulls the ski poles forward, the paddles surface and slide across the water as the water craft moves forward.

26 Claims, 9 Drawing Sheets

PERSONAL WATER CRAFT TO ENABLE A USER TO WALK ON WATER

FIELD

This invention relates generally to water craft.

BACKGROUND

In the past, many different devices for walking on water have been constructed to simulate the natural walking motion. Prior attempts at creating a foot-worn floatation/propulsion system have yet to produce a water-walking device that enables a human to simulate walking while propelling the device efficiently.

The act of walking, on land or on water, can be broken down into a sequence of coordinated basic movement pairs (each pair comprising a left leg movement and a right leg movement). There are four basic movements: Forward, an actual forward movement of the first leg and foot; Backward, the backward push against the resistance of the ground during which the second foot does not actually move; Up, the lifting the first leg off the ground or un-weighting of the leg during the movement; and Down, applying one's weight on the first leg. The act of walking naturally requires the smooth transition from one action to the next, and from one leg to the next. Any water-walking device should allow for all four movements in the normal sequence and with the natural timing a human has learned when walking on land.

A typical prior water walking device includes two elongated floats and some sort of variable resistance propulsion mechanism, typically having a multitude of either small rotatable flaps or fixed, rearward facing cups, pouches, or scoops. The typical prior float is generally flat bottomed and straight sided and the typical prior propulsion mechanism does not provide maximum resistance against the water at the point in the walking cycle when it is needed. Moreover, these mechanisms remain submerged during use of the water walking device, thereby providing resistance against forward motion. These devices sometimes include an oar for rowing the water-walking device. However, the oars do not operate well with the natural walking motion.

Some prior devices include a tethering mechanism to keep the floats from separating. Many of these mechanisms are overly constraining—that is, rather than just preventing excessive transverse separation, they instead prevent the user's feet from moving in at least some of the degrees of freedom possible on land. Typically, the tether mechanism, if present, either inhibits a full and natural stride (i.e., the length of a step), introduces friction into what is normally a frictionless forward leg movement, prevents the redirection of a forward stride (yaw) (as is needed for turning), or inhibits the required Up and Down leg movements.

It is therefore desirable to design a water-walking device that efficiently travels over water using the natural walking motion.

SUMMARY

An embodiment of the present disclosure is directed to a water craft system. The water craft includes a ski configured to float on water and having a housing configured to receive a user's foot; and a propulsion device coupled to the ski and configured to grip the water and submerge the propulsion device in response to a force applied to the propulsion device in a direction approximately opposite a direction of motion.

Another embodiment of the present disclosure is directed to a propulsion device for propelling a craft in water. The propulsion device comprises a semi-buoyant float including a surface configured to grip the water and submerge the float in response to a force applied to the float in a direction approximately opposite a direction of motion of the craft.

Another embodiment of the present disclosure is directed to a housing for receiving a users foot. The housing includes a bottom surface positioned at a height below a top surface of the housing; a raised platform coupled to the bottom surface; a foot platform coupled to the raised platform at a front portion of the foot platform and configured to rotate parallel to an axis of the ski; and a semi-elastic member coupled to the housing and a rear portion of the foot platform. The semi-elastic member provides tension as the foot platform rotates.

Additional embodiments of the disclosure will be set forth in part in the description which follows, and in part will be obvious from the description, or may be learned by practice of the present disclosure. The embodiments of the disclosure will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the disclosure and together with the description, serve to explain the principles of the embodiments.

DESCRIPTION OF THE EMBODIMENTS

Figure 1:
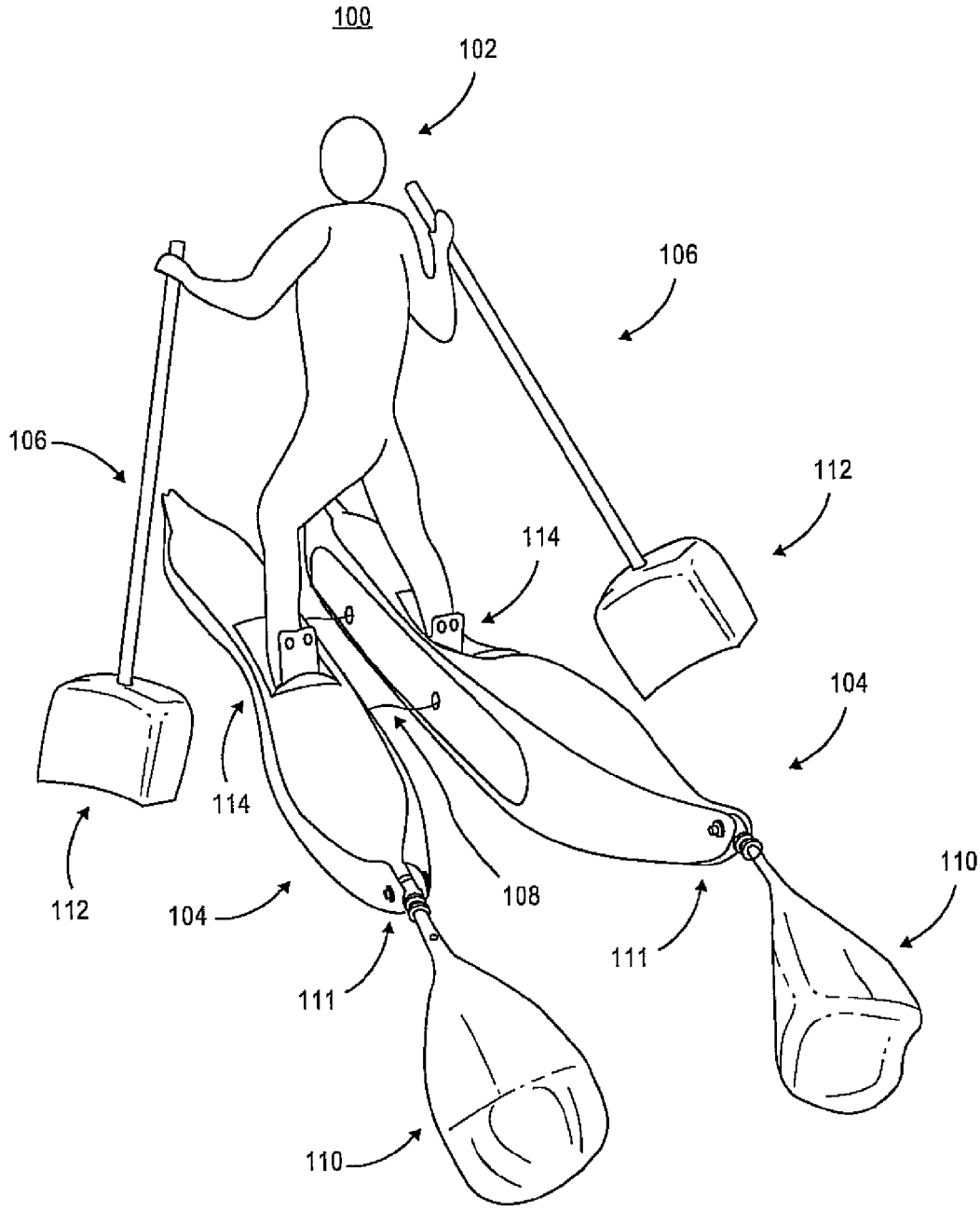
FIG. 1 is a general schematic diagram illustrating a water craft consistent with embodiments of the present disclosure.

According to embodiments of the present disclosure, a water craft allows a user to travel across a surface of water utilizing a natural walking motion. The water craft includes a pair of skis adapted to fit on the user's feet. The skis can be coupled together by semi-elastic tethers. Each ski can include a foot well for receiving the user's foot. The foot well is designed to simulate the natural walking motion of the user.

The user can propel the water craft using tail paddles and ski poles. The tail paddles and ski poles allow the user to utilize both arms and legs in a motion similar to cross-country snow skiing to propel the water craft. Unlike flaps or paddles which only push water, the tail paddles and ski poles provide resistance based on the force that is required to submerge a buoyant object.

The tail paddles are coupled to the rear of the skis. The tail paddles are configured to float on the water and to rotate about a transverse axis of the skis. The tail paddles are shaped to grip or "dig in" the water in response to the user moving the skis in a direction opposite the direction of motion of the water craft. The tail paddles provide resistance to propel the water craft when the ski is moved backward and slide along the water when the skis move forward.

The ski poles include a paddle shaped to grip or "dig in" in response to the user pushing backwards on the ski poles. The paddle provides resistance to the backwards motion to propel the water craft forward. When the user pulls the ski poles forward, the paddles surface and slide across the water as the water craft moves forward.

Reference will now be made in detail to the exemplary embodiments of the present disclosure, an example of which is illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments which may be practiced. These embodiments are described in sufficient detail to enable those skilled in the art to practice the embodiments and it is to be understood that other embodiments may be utilized and that changes may be made without departing from the scope of the invention. The following description is, therefore, merely exemplary.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

FIG. 1 is a general schematic diagram of a water-walking water craft 100 for a user 102 consistent with embodiments of the present disclosure. Water craft 100 includes skis 104, ski poles 106, and two tethers 108 connecting skis 104. It should be readily apparent to those of ordinary skill in the art that water craft 100 illustrated in FIG. 1 represents a generalized illustration and that other components may be added or existing components may be removed or modified.

Water craft 100 allows user 102 to travel across a water medium by performing a natural walking motion. Water craft 100 employs a propulsion system based on buoyant resistance. The propulsion system functions to allow user 102 to simulate a walking motion found in cross country skiing or elliptical exercise machines.

The propulsion system includes skis 104 and ski poles 106. Skis 104 include tail paddles 110 coupled to the rear portion of skis 104. Skis 104 with tail paddles 110 allow user 102 to propel water craft 100 using a walking motion found in cross country skiing or elliptical exercise machine. Tail paddles 110 can be constructed of a semi-buoyant material to allow tail paddles 110 to float on top of the water or to be partially submerged in the water. Tail paddles 110 can be coupled to skis 104 by a pivot joint 111 that allows tail paddles 110 to rotate about a transverse axis of skis 104.

Tail paddles 110 are shaped to grip or "dig in" the water in response to user 102 moving skis 104 in a direction opposite the direction of motion of water craft 100 (i.e. backwards). When skis 104 are moved backwards, tail paddles drop down by rotating about a transverse axis at pivot joint 111 and grip or "dig in" the water. As tail paddles 110 grip the water, tail paddles 110 are partially submerged in the water. As tail paddles 110 submerge, user 102 is provided with resistance to the backwards motion in order to propel water craft 100 forward. When user 102 pulls ski 104 forward, tail paddles 110 surface and slide across the water. By sliding across the water, tail paddles 110 do not contribute a large amount of resistance to water craft 100 moving forward.

Water craft 100 propulsion system also includes ski poles 106. Ski poles 106 include paddles 112. Paddles 112 are shaped similar to tail paddles 110. Ski poles 106 allow user 102 to further propel water craft 100 using an arm motion found in cross country skiing or elliptical exercise machines. Paddles 112 can be shaped to grip or "dig in" in response to user 102 pushing backwards on ski poles 106. As paddles 112 grip the water, paddles 112 can be partially submerged in the water. As paddles 112 submerge, user 102 is provided with resistance to the backwards motion to propel water craft 100 forward. When user 102 pulls ski poles 106 forward, paddles 112 surface and slide across the water as water craft 100 moves forward. As such, user 102 does not have to lift ski poles 106 to propel water craft 100, but merely push backwards on ski poles 106 and slide ski poles 106 forward along the water. By sliding across the water, paddles 112 do not contribute a large amount of resistance to water craft 100 moving forward.

Skis 104 can include a foot well 114 for receiving the foot of user 102. Foot well 114 includes a raised platform (not shown) in foot well 114. A foot platform (not shown) may be placed on the raised platform on which user 102 may stand. A boot may be attached to the foot platform to receive the foot of user 102. The foot platform may be coupled to the raised platform in the front by a hinge. The back of the foot platform may be attached to the raised platform or bottom of the foot well by an elastic strap.

The hinge and elastic strap allow user 102 to simulate walking when propelling water craft 100. When user 102 lifts a foot, the foot platform can tip forward and the tension of the elastic strap can provide tension to pull skis 104 forward. The two-point connection allows user 102 to pull skis 104 forward with both foot and leg. Foot well 114 can also include an interior hull access portal (not shown) at the front and/or back of foot well 114.

Foot well 114 can also include a slosh bailing system (not shown) that removes water from foot well 114 utilizing motion of skis 104. The slosh bailing system may comprise drain troughs with drain holes at the front and back of foot well 114. The drain holes may be located above the water line of skis 104 in order to drain water. Sloped ramps may be placed between the drain troughs and the bottom of foot well 114. As water gets into foot well 114, the back and forth motion of ski 104 will "slosh" the water forward and back and into the drain troughs. Further, the raised platform of foot well 114 may push the water into the drain troughs as skis 104 move back and forth.

Water craft 100 can also provide a stable system for traveling over water by including tethers 108 between skis 104. Tethers 108 may be coupled to both skis 104 at the front and rear portion of foot wells 114. For example, tethers 108 may be connected through drain holes in foot wells 114. Tethers 108 are connected at a point to prevent destabilization of skis 104 and to prevent obstruction of the forward and backward motion of skis 104. For example, tethers 108 may be coupled at a point just above the water line. One skilled in the art will realize that the number of tethers 108 coupled between skis 104 in exemplary and that any number of tethers 108 may be utilized to prevent destabilization of skis 104.

Tethers 108 are constructed of an elastic or semi-elastic material. For example, tethers 108 may be constructed of natural rubber, synthetic rubber, nylon and the like, and combinations thereof. Tethers 108 function to maintain a proper distance between skis 104. Tethers 108 also provide stride control and serve to pull skis 104 together as one ski is pulled forward while the other is pushed back. One skilled in the art will realize that tethers 108 are not limited to the exemplary materials mentioned above, but may be formed of any elastic or semi-elastic material. Further, tethers 108 can be retractable and of a non-elastic material.

Tethers 108 can be adjustable in order to increase or decrease the distance between skis 104. Tethers 108 may be adjusted for a walking stride of user 102. Due to the elasticity or retraction components, tethers 108 provide "spring back" as skis 104 reach the length of the pre-adjusted stride. Further, the elastic or semi-elastic nature may allow graduated tension that provides extra balance as skis 104 reach the end of user 102 stride.

Skis 104 can be designed and shaped to provide a stable support for user 102 in motion across water. Skis 104 may be formed of any buoyant material to support user 102 on top of the water. For example, skis 104 may be formed of a fiberglass, wood, plastic and the like, and combinations thereof. Skis 104 may be designed as a shell with the inner cavity of skis 104 being hollow and filled with a gas, such as air. Likewise, the inner cavity of skis 104 may be filled with a buoyant material, such as foam. One skilled in the art will realize that skis 104 are not limited to the exemplary materials mentioned above, but may be formed of any buoyant or semi-buoyant material.

Skis 104 can be designed with a single hull design. That is, skis 104 can be designed such that the same ski may be utilized for either for the left and the right ski. Skis 104 may be turned in opposite directions to create a left and right ski with flat surface to the inside, toward the other ski 104.

Figure 3:
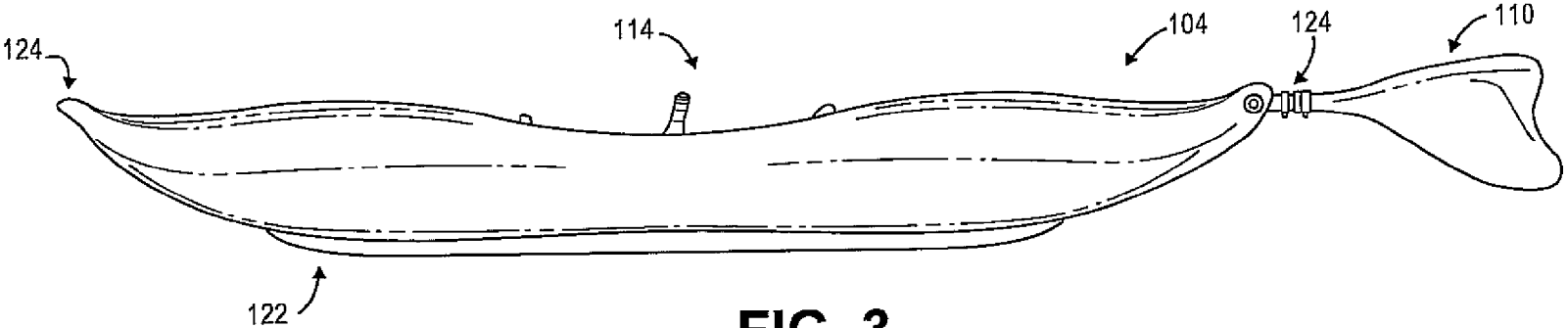
FIGS. 2-4 are diagrams illustrating a ski of the water craft consistent with embodiments of the present disclosure.
Figure 2:
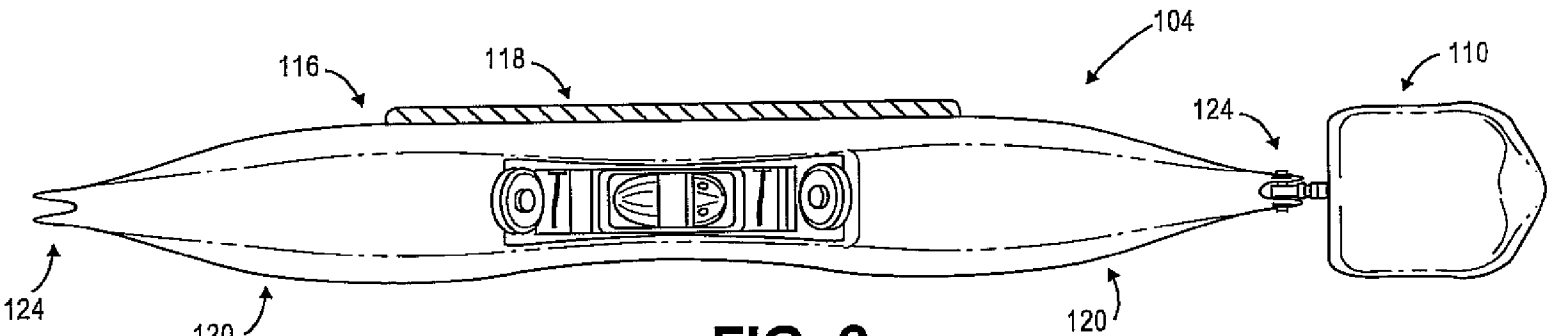
Figure 4:
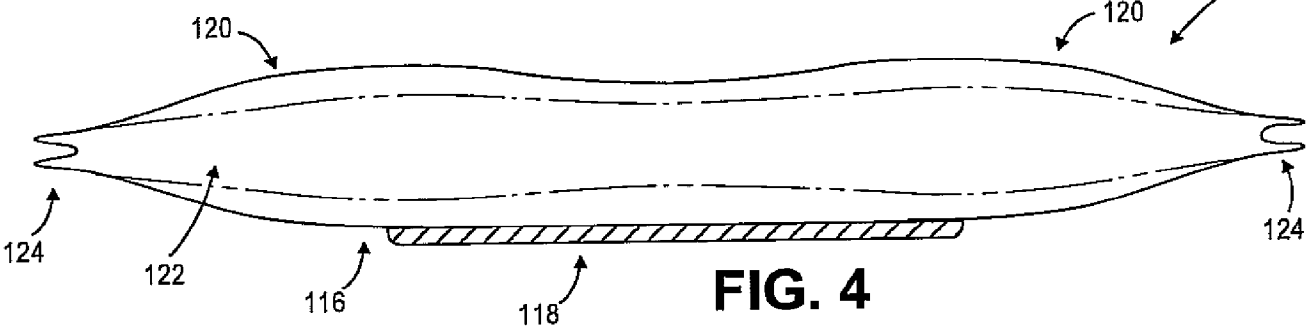

FIGS. 2, 3, 4 are general diagrams illustrating a top view, side view, and bottom view, respectively, of the left ski 104 in water craft 100. Since skis 104 have a single hull design, skis 104 will be described with reference to left ski 104. One skilled in the art will realize that right ski 104 will include the same components as left ski 104.

As illustrated in FIG. 2, ski 104 can be designed so that an inside surface 116 is flat. As such, user 102 may move skis 104 closer together without skis 104 unevenly striking during motion. Further, skis 104 may move back and forth relative to each other without obstruction between skis 104.

Skis 104 include several features for stabilizing skis 104 during motion. Ski 104 includes a bumper slide guard 118. Bumper slide guard 118 can provide inside floatation. If ski 104 begins to roll inward, bumper slide guard 118 provides buoyancy to stabilize ski 104. Additionally, bumper slide guard 118 allows skis 104 to strike each other and slide without noise or damage.

Bumper slide guard 118 can be constructed of any material that is buoyant or semi-buoyant to provide cushioning between skis 104. For example, bumper slide guard may 118 be formed rubber, synthetic rubber, foam, plastic and the like, and combinations thereof. Bumper slide guard 118 may be attached to skis 104 by any suitable device to secure bumper slide guard 118 to skis 104 during use. For example, bumper slide guards 118 may be attached with glue, epoxy, screws, bolts, nails and the like, and combinations thereof. One skilled in the art will realize that bumper slide guard 118 is not limited to the exemplary materials mentioned above, but may be formed of any buoyant or semi-buoyant material.

Additionally for stability, ski 104 can include outside stabilizer glides 120. Outside stabilizer glides 120 can be formed as part of ski 104. Outside stabilizer glides 120 can be elliptical bulges on the outside front and back portion of ski 104. The elliptical bulges begin at the front and rear of ski 104 and terminate at approximately the center of foot well 114. Outside stabilizer glides 120 provide floatation on the outside of ski 104 to prevent skis 104 from tilting outward.

Since stabilizer glides 120 terminate at the center of foot well 114, user 102 may easily position ski poles 106 immediately below the center of gravity of user 102. Additionally, the elliptical curve of outside stabilizer glides 120 guides ski poles 106 away from ski 104 as user 102 pushes ski pole 106 backwards. Further, when skis 104 are pulled tight together for sitting, outside stabilizer glides 120 reduce the tendency of water craft 100 to turn over as a single unit.

As illustrated in FIGS. 3 and 4, ski 104 can include a keel 122. User 102 rides on top of keel 122 with stabilizer assistance from bumper slide guards 118 and outside stabilizer glides 120. The bottom of keel 122 may be relatively flat to allow user 102 to walk from the shore into the water. For example, keel 122 may be substantially flat under foot well 114 and can curve upward towards the top of ski 104 at the front and rear of the ski.

Skis 104 may be constructed to various dimension to accommodate different sized and weight users 102. For example for a typical adult user 102, ski 104 may be constructed to a length in the range of approximately 5 feet to 8 feet. For a typical adult user 102, ski 104 may be constructed to a height in the range of approximately 0.5 feet to 2 feet. For a typical adult user 102, ski 104 may be constructed to a width at the largest point of elliptical bulges 120 in the range of approximately 1 foot to 5 feet and the smallest point of elliptical bulges 120 in the range of approximately 0.5 feet to 3 feet. One skilled in the art will realize that the dimensions mentioned above are exemplary and the dimension may be increase or decreased to provide stability to ski 104.

Ski 104 can also include notches 124 for connecting tail paddle 110 to ski 104. Skis 104 may be turned in opposite directions to create a left and right ski with flat surface to the inside, toward the other ski 104. Since skis 104 are designed such that the same ski may be utilized for either for the left or right ski, tail paddle 110 may be connected to either the front or back notch 124 depending on the whether ski 104 is used as a right or left ski.

Figure 5:
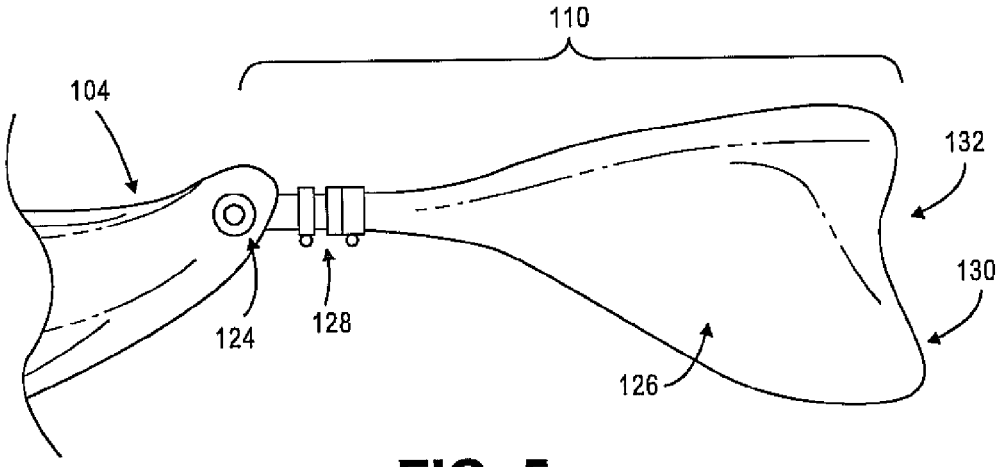
FIGS. 5 and 6 are diagrams illustrating a tail paddle of the ski consistent with embodiments of the present disclosure.
Figure 6:
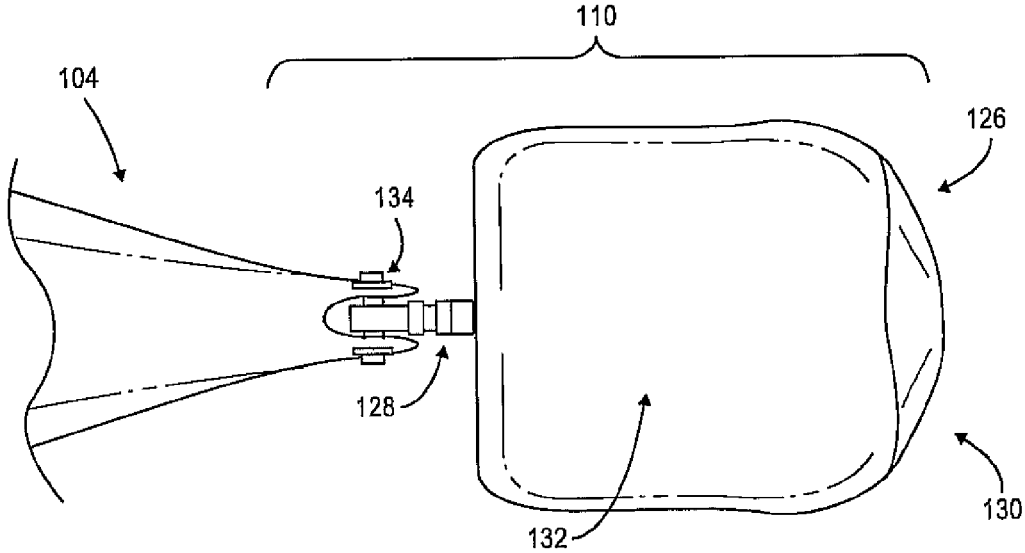

FIGS. 5 and 6 are diagrams illustrating a detailed side and top view, respectively, of the rear of ski 104 and tail paddle 110. As illustrated in FIG. 5, tail paddle 110 is coupled to ski 104 at notch 124. Tail paddle 110 includes a float 126 and a swing arm 128.

Float 126 may be constructed of any buoyant or semi-buoyant material capable of floating on water. For example, float 126 may be constructed of rubber, synthetic rubber, foam, plastic, fiberglass, wood and the like, and combinations thereof. Depending on material, float 126 may be solid or hollow. For example, float 126 may be constructed of solid foam. Likewise, float may be constructed of a plastic or fiberglass shell filled with a gas, such as air, or foam, and combinations thereof. One skilled in the art will realize that float 126 is not limited to the exemplary materials mentioned above, but may be formed of any buoyant or semi-buoyant material.

Swing arm 128 couples float 126 to ski 104. Swing arm 128 may be constructed of any type of rigid material suitable for supporting float 126. For example, swing arm 128 may be constructed of metal, plastic, fiberglass, wood and the like, and combinations thereof. Float 126 may be coupled to swing arm 128 to securely hold float 126 to swing arm 128. For example, float 126 may be coupled to swing arm 128 with glue, epoxy, screws, bolts, nails and the like, and combinations thereof. One skilled in the art will realize that swing arm 128 is not limited to the exemplary materials mentioned above, but may be formed of any material.

Swing arm 128 can be coupled to ski 104 at notch 124. Swing arm can be coupled to ski 104 to allow tail paddle 110 to rotate parallel to the long plane of ski 104 and about a transverse axis thereof as illustrated in FIG. 6. Swing arm 128 can include an eye hole (not shown) coupled to ski 104. The eye hole can be at a terminal end of the swing arm. A pin 134 can be coupled to notch 124 and inserted through the eye hole to couple swing arm 128 to ski 104. As such, tail paddle 110 may rotate about pin 134. Pin 134 may be detachable to allow tail paddle 110 to be removed and connected to the other end of ski 104.

Float 126 of tail paddle 110 is shaped to grip or "dig in" in response to user 102 moving skis 104 in a direction opposite the direction of motion of water craft 100 (i.e. backwards). Float 126 is shaped with a protrusion 130 and concave portion 132 similar to a scoop.

Figure 7B:
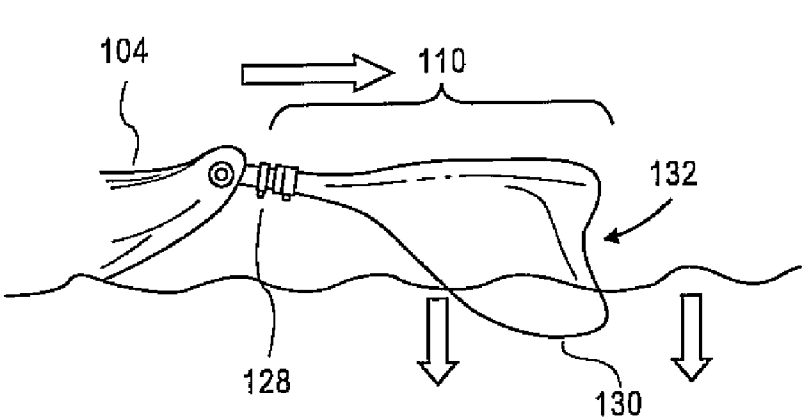
FIGS. 7A-7C are diagrams illustrating operation of the tail paddle consistent with embodiments of the present disclosure.
Figure 7A:
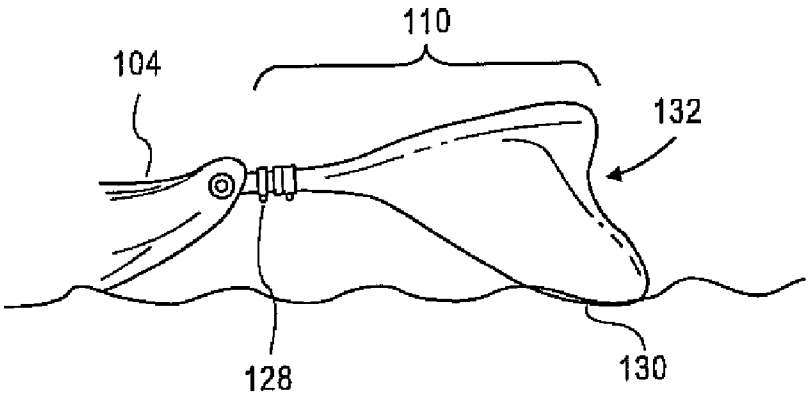
Figure 7C:
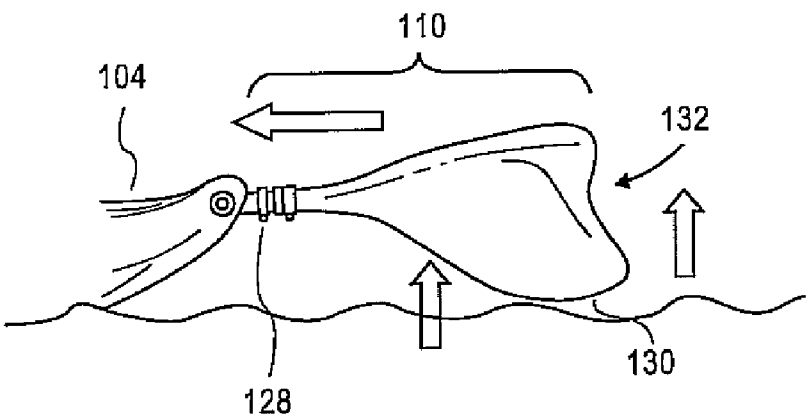

FIGS. 7A-7C are diagrams illustrating the operation of tail paddle 110 consistent with embodiments of the present disclosure. As illustrated in FIG. 7A, when ski 104 is not in motion, tail paddle 110 floats on top of the water. When ski 104 is moved backwards, protrusion 130 grips or "digs in" the water and tail paddle 110 drops downward by rotation about the pivot.

As protrusion 130 grips the water, float 126 is partially submerged in the water as illustrated in FIG. 7B. As float 130 submerges, concave portion 132 provides resistance to the backward motion thereby propelling water craft 100 in a forward direction. When user 102 pulls ski 104 forward, the buoyant force of float 126 causes tail paddle 110 to rotate upward and surface as illustrated in FIG. 7C. Float 126, then, slides across the water as water craft 100 moves forward. By sliding across the water, float 126 does not contribute a large amount to resistance of ski 104 moving forward.

Figure 8:
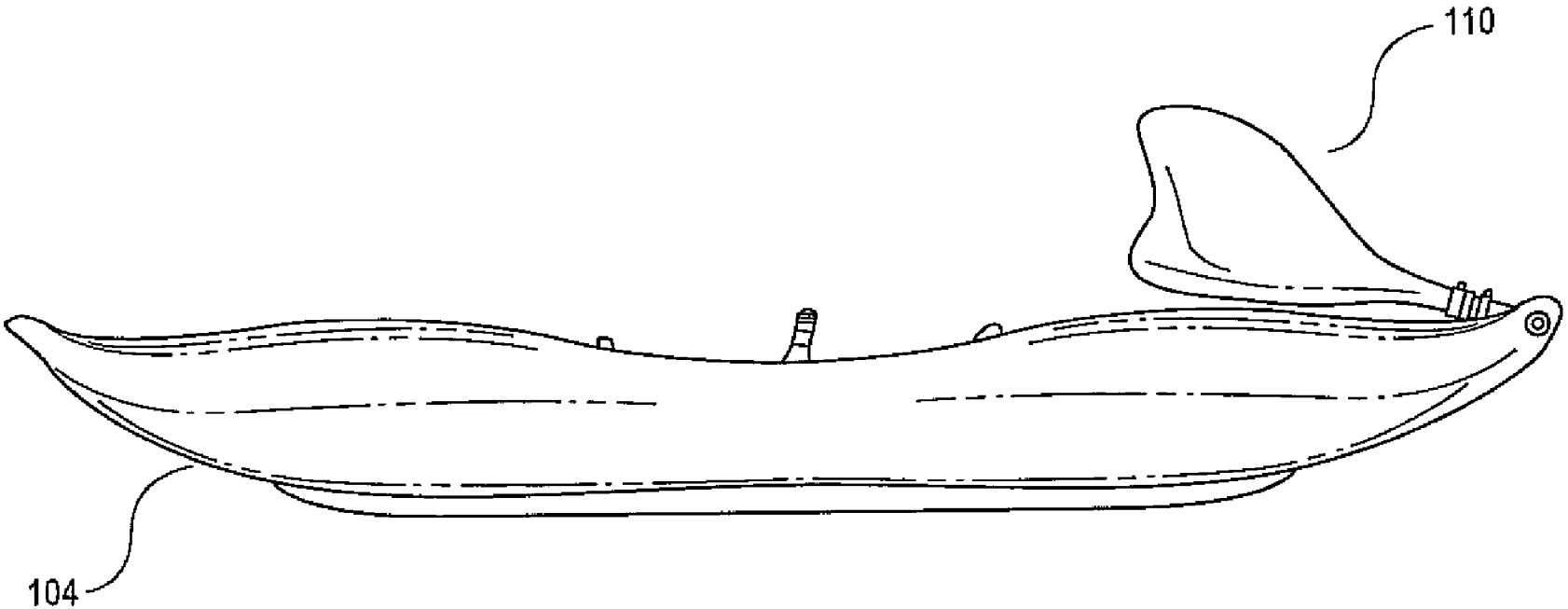
FIG. 8 is a diagram illustrating a side view of the ski and tail paddle consistent with embodiments of the present disclosure.

In addition to pivoting during motion, tail paddles 110 may be flipped up to rest on top of skis 104. FIG. 8 is a diagram illustrating tail paddles 110 rotated up to rest on skis 104 consistent with embodiments of the present disclosure. When tail paddles are rotated up, user 102 may utilize tail paddles 110 as a back rest while sitting on skis 104. Further, tail paddles 110 may be rotated up for transport or storage of skis 104.

Figure 9:
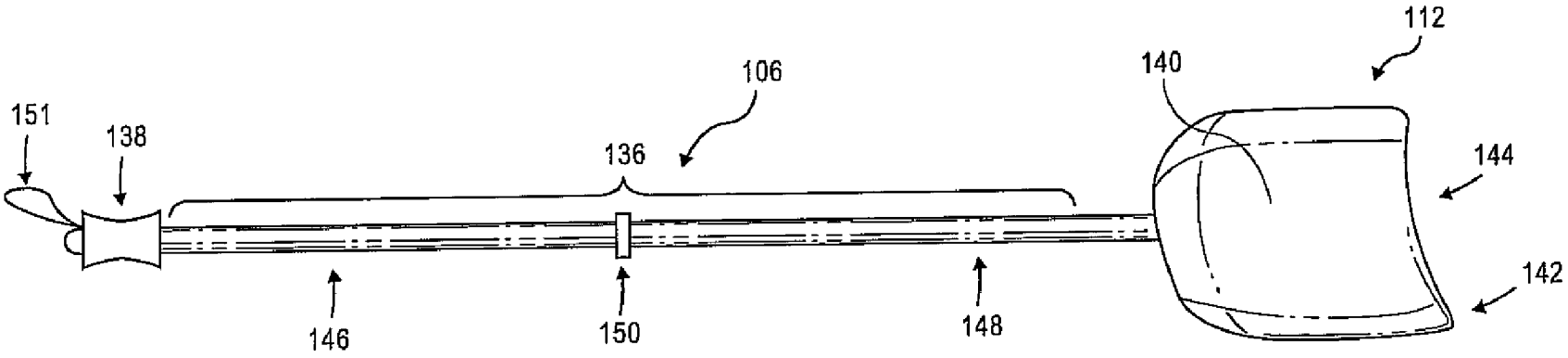
FIGS. 9 and 10 are diagrams illustrating a ski pole consistent with embodiments of the present disclosure.
Figure 10:
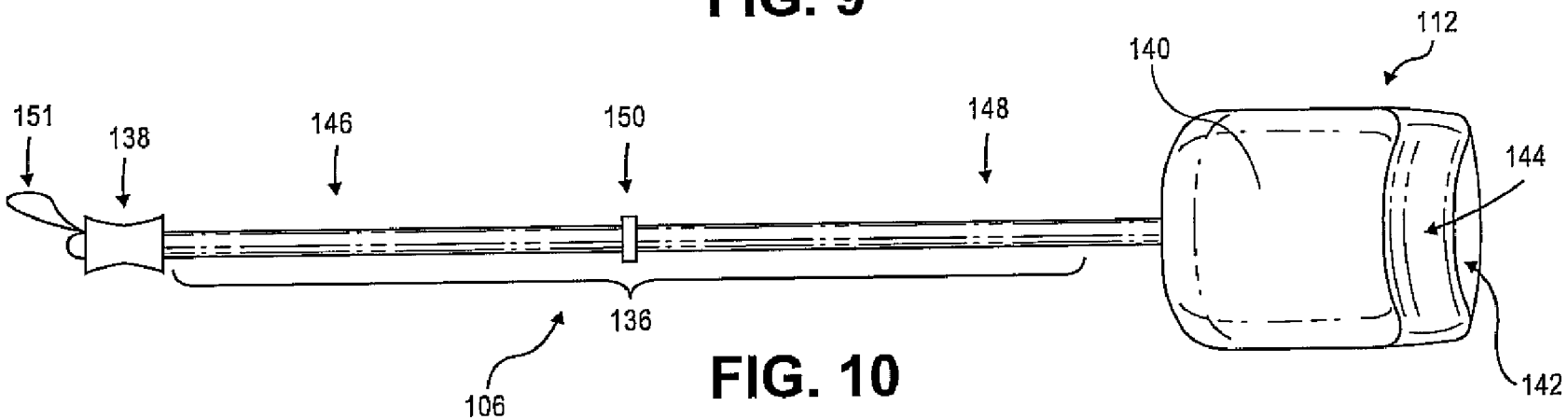

In addition to tail paddles 110, user 102 may propel water craft 100 using ski poles 106. FIGS. 9 and 10 are diagrams illustrating one of ski poles 106 consistent with embodiments of the present disclosure. Ski pole 106 can include a paddle 112, handle 136, and grip 138.

Pole paddles 112 can be shaped similar to and function as tail paddles 110 described above. Paddles 112 can include a float 140. Float 140 can include a protrusion 142 and a concave portion 144. Float 140 may be constructed of any buoyant or semi-buoyant material capable of floating on water. For example, float 140 may be constructed of rubber, synthetic rubber, foam, plastic, fiberglass, wood and the like, and combinations thereof. Depending on material, float 140 may be solid or hollow. For example, float 140 may be constructed of solid foam. Likewise, float may be constructed of a plastic or fiberglass shell filled with a gas, such as air, or foam. One skilled in the art will realize that float 140 is not limited to the exemplary materials mentioned above, but may be formed of any buoyant or semi-buoyant material.

Float 140 of paddle 112 can be shaped to grip or "dig in" in response to user 102 moving ski pole 106 in a direction opposite the direction of motion of water craft 100 (i.e. backwards). When user pushes backwards on ski pole 106, protrusion 142 grips or "digs in" the water. As protrusion 142 grips the water, float 140 is partially submerged in the water.

As float 140 submerges, concave portion 144 provides resistance against the force applied by user 102. When user 102 pulls ski pole 106 forward, the buoyant force of float 140 causes float 140 to surface. Float 140, then, slides across the water as water craft 100 moves forward. By sliding across the water, user 102 is not required to lift ski pole 106 above the water.

User 102 holds onto ski pole 106 at grip 138. Grip 138 may be shaped to fit the contour of the human hand. Grip 138 may be constructed of any material that is comfortable to hold and provide a suitable gripping surface. For example, grip 138 may be constructed of rubber, synthetic rubber, plastic, wood and the like, and combinations thereof. One skilled in the art will realize that grip 138 is not limited to the exemplary materials mentioned above, but may be formed of any material.

Grip 138 can be coupled to handle 136 which is in turn attached to paddle 112. Handle 136 may be coupled to grip 138 and paddle 112 to securely hold grip 138 and paddle 112 to handle 136. For example, handle 136 may be coupled to grip 138 and paddle 112 with glue, epoxy, screws, bolts, nails and the like, and combinations thereof.

Additionally, ski pole 106 can include a strap 151 that may be placed around user 102 wrist. Strap 151 can prevent user 102 from losing ski pole 106 in the event user 102 releasts hold on grip 138. Strap 151 can be attached to grip 138 or handle 136. Strap 151 can include a connector (not shown) to allow user 102 to increase or decrease the size of strap 151.

Since not every user 102 may be the same height or have the same arm length, handle 136 may be adjustable to increase or decrease the length of handle 136. In such a case, handle 136 may include an upper bar 146 and a lower bar 148. Lower bar 148 may be constructed to a slightly larger diameter than upper bar 146. As such, upper bar 146 may slide inside of lower bar 148 in a telescoping manner to increase and decrease the length of handle 136. To hold upper bar 146 in place, a locking mechanism 150 may be attached to the upper portion of lower bar 148. Locking mechanism 150 may provide pressure to upper bar 146 to hold upper bar 146 in place relative to lower bar 148 during use.

Figure 11:
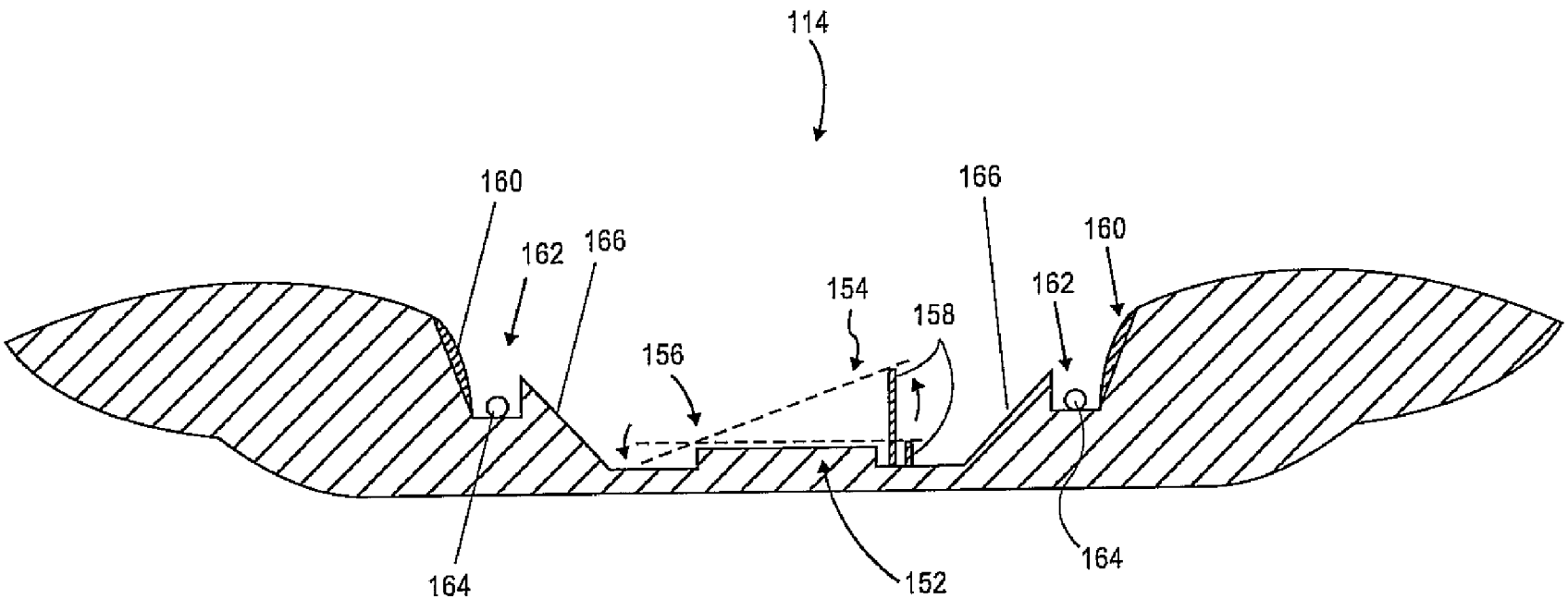
FIGS. 11 and 12 are diagrams illustrating a foot well consistent with embodiments of the present disclosure.

As mentioned above, skis 104 include a foot well 114 for receiving user 102 foot. FIG. 11 is a cross section of one ski 104 illustrating foot well 114 consistent with embodiments of the present disclosure. Foot well 114 includes a raised platform 152 and a foot platform 154.

Foot platform 154 provides an area on which user 102 may stand. Foot platform 154 is placed on and coupled to raised platform 152. A boot (not shown) may be attached to foot platform 154 to receive user 102 foot.

The front portion of foot platform 154 may be coupled to raised platform 152 by a hinge 156. The back portion of foot platform 154 may be coupled to either raised platform 152 or the bottom of foot well 154 by an elastic strap 158. Hinge 156 and elastic strap 158 allows user 102 to simulate walking when propelling water craft 100. When user 102 lifts a foot, foot platform 154 would tip forward and the tension of the elastic strap would provide tensions to pull skis 104 forward. The two-point connection may allow user 102 to pull skis 104 forward with both foot and leg.

Foot well 114 may also include interior hull access portals 160 at the front and/or back of foot well 114. Access portals 160 may be constructed of any suitable material and in any suitable design to allow access to the interior of skis 104. For example, access portals 160 may be conventional marine access portals.

Foot well 114 may also include a slosh bailing system that removes water from foot well 114 by motion of skis 104. The slosh bailing system may include drain troughs 162 with drain holes 164 at the front and back of foot well 114. Drain holes 164 may be located above the water line of skis 104 in order to drain water. Sloped ramps 166 may be placed between drain troughs 162 and the bottom of foot well 114. As water gets into foot well 114, the back and forth motion of ski 104 will "slosh" the water forward and up sloped ramps 166 into drain troughs 162. Further, raised platform 152 of foot well 114 may push the water up sloped ramps 166 into drain troughs 162 as skis 104 move back and forth.

Figure 12:
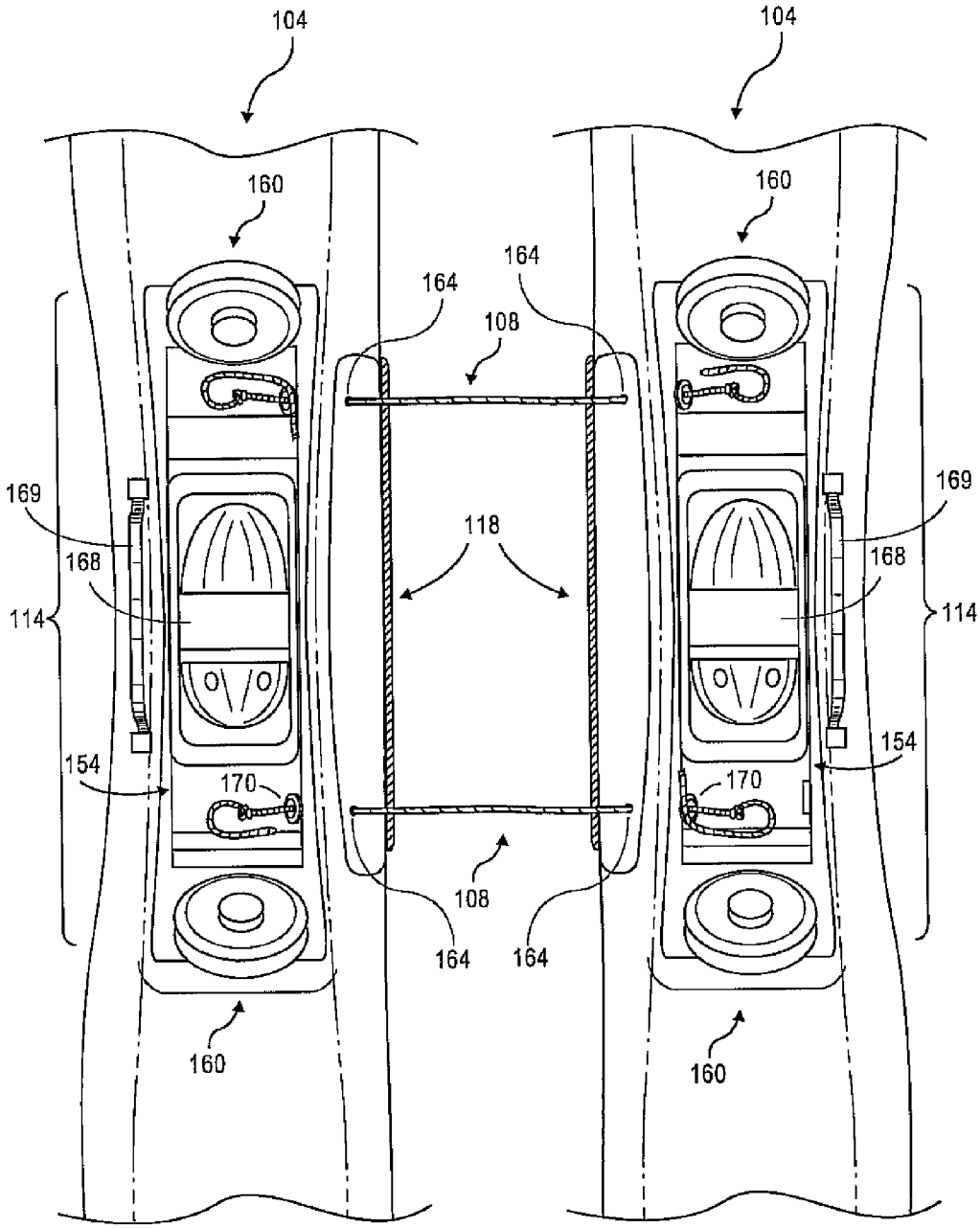

FIG. 12 is a diagram illustrating a top view of foot platform 114 consistent with embodiments of the present disclosure. As illustrated, foot well 114 may include a boot 168 placed on foot platform 154.

Boot 168 may be constructed of any suitable material in order to receive the foot of user 102. For example, boot 168 may be constructed of rubber, synthetic rubber, plastic and the like, and combinations thereof. One skilled in the art will realize that boot 168 is not limited to the exemplary materials mentioned above, but may be formed of any material. Boot 168 may also be adjustable in order to increase or decrease the size of boot 168 to fit the foot of user 102.

Additionally, as illustrated in FIG. 12, handles 169 can be coupled to skis 104. Handles 169 can be coupled to skis 104 at an outside portion of skis 104 near foot well 114. Handles 169 allow user 102 to hold onto skis 104 by grasping handles 169. Handles 169 can be constructed to any size to allow user 102 to securely grasp and hold onto handles 169.

Handles 169 can be constructed of any materials that allow user 102 to grasp and hold onto handles 169. For example, handles 169 can be constructed of metal, plastic, fiberglass, wood and the like, and combinations thereof. Handles 169 may be coupled to skis 104 to securely hold handles 169 to ski 104. For example, handles 169 may be coupled to skis 104 with glue, epoxy, screws, bolts, nails and the like, and combinations thereof. One skilled in the art will realize that handles 169 are not limited to the exemplary materials mentioned above, but may be formed of any material.

Additionally as illustrated in FIG. 12, tethers 108 can be coupled to skis 104 through drain holes 164. Drain holes 164 can be large enough to accommodate tethers 108 and still allow water to drain from foot wells 114. Further, tethers 108 can include locking mechanisms 170 in order to increase and decrease the length between skis 104.

Figure 13:
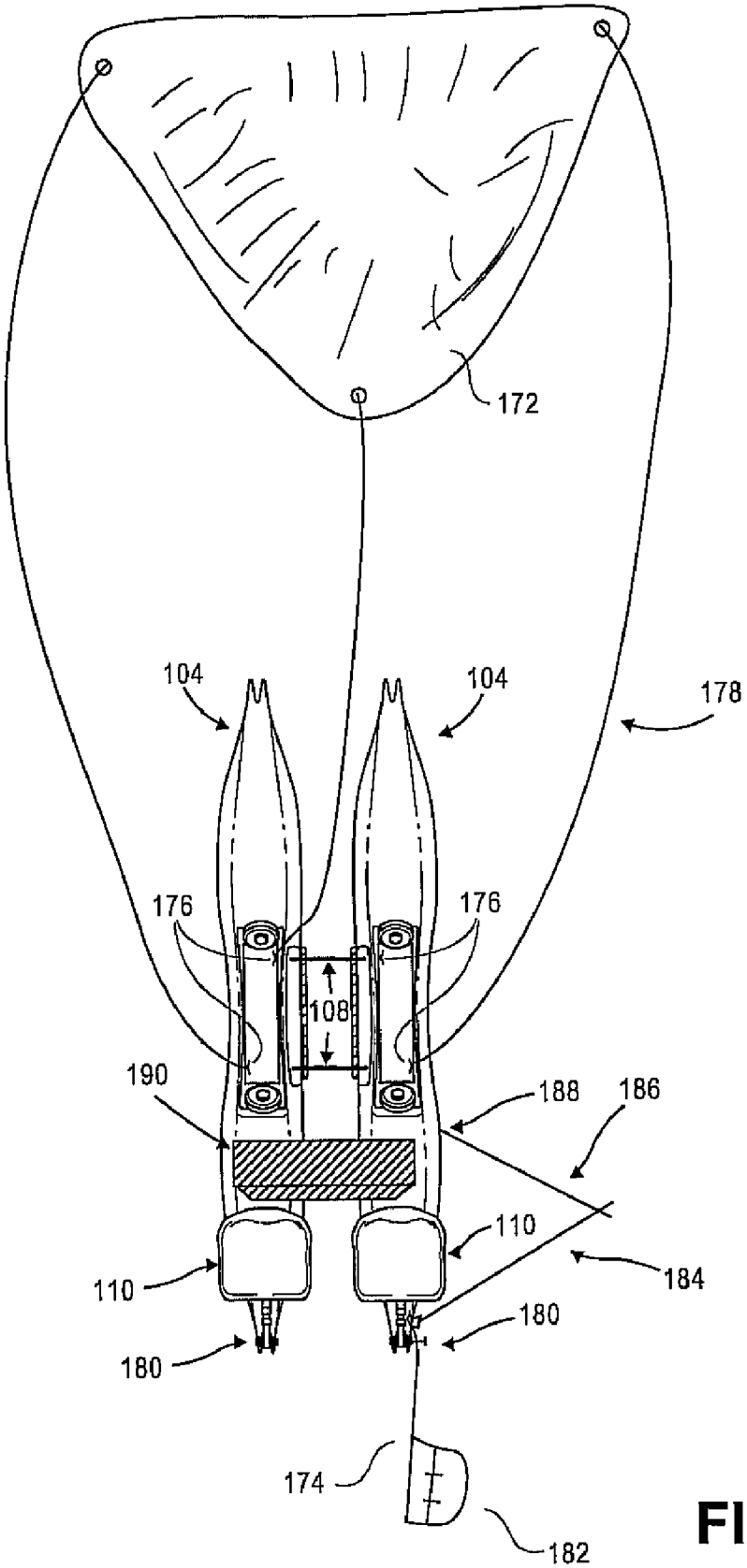
FIG. 13 is a diagram illustrating another configuration of the water craft consistent with embodiments of the present disclosure.

In addition to being propelled by user 102, water craft 100 may be configured to be propelled by wind. FIG. 13 is a general schematic diagram illustrating water craft 100 configured to be propelled by wind consistent with embodiments of the present disclosure. In this configuration, water craft 100 may include a triangular kite sail 172 and a rudder 174.

Kite sail 172 provides propulsion to water craft 100. Kite sail 172 may be formed of any material in order to catch wind to propel water craft 100. For example kite sail 172 may be constructed of any suitable synthetic or natural material such as nylon, silk, cotton, canvas and the like, and combinations thereof. One skilled in the art will realize that kite sail 172 is not limited to the exemplary materials mentioned above, but may be formed of any light weight material.

In order to couple kite sail 172 to skis 104, skis 104 may include cleats 176. Cleats 176 may be located inside foot well 114. To couple sail 172 to skis 102, light weight ropes 178 may be coupled to the corners of kite sail 172 and tied off at cleats 176. Ropes 178 may be any type of suitable ropes used in sailing or kite devices.

To control water craft 100, rudder 174 may be coupled to the rear of either skis 104. To couple rudder 174, pin 134, in notch 124, may be replaced with a rudder bolt that will hold both tail paddles 110 and rudder 174.

Rudder 174 may include a fin 182 and a tiller arm 184. Fin 182 may be submerged in the water in order to direct the motion of water craft 100. To direct the motion, user 102 may turn fin 182 using tiller arm 184. To provide ease of use for user 102, a tiller arm extender 186 may be attached to tiller arm 184. Further, skis 104 may include a strap 188. Strap 188 may allow user 102 to attach tiller arm extender 186 to ski 104 for hands free use.

To provide a seat for user 102, tail paddles 110 may be rotated into the up position to allow user 102 to lean against tail paddles 110. Optionally, water craft 110 may include an inflatable seat 190. Inflatable seat 190 may be placed against tail paddles 110 to provide additional support. Inflatable seat 190 may be inflatable by user 102 or may be self inflating.

To operate water craft 100 in a sailing configuration, user 102 may decease the length of tethers 108 to abut skis 104 against each other. Then, user 102 may rotate tail paddles 110 into the up position. Kite sail 172, rudder 174, ropes 178, tiller arm extender 186, and inflatable seat 190 may be stored inside skis 104. User 102 may retrieve the components via access ports 160.

Other embodiments of the present disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A water craft system, comprising:

a ski configured to float on water and comprising a housing configured to receive a user's foot;

a propulsion device coupled to the ski and capable of floating on water, wherein the propulsion device is configured to grip the water and submerge a portion of the propulsion device in response to a force applied to the propulsion device in a direction approximately opposite a direction of motion of the water craft system and wherein the submerged portion of the propulsion device provides resistance for the user to propel the ski;

a second ski configured to float on water and comprising a second housing configured to receive a user's foot; and a second propulsion device coupled to the second ski and capable of floating on water, wherein the second propulsion device is configured to grip the water and submerge a portion of the second propulsion device in response to a force applied to the second propulsion device in a direction approximately opposite a direction of motion of the water craft system and wherein the submerged portion of the second propulsion device provides resistance for the user to propel the second ski, wherein the ski further comprises a flat surface adjacent to the second ski, wherein the second ski further comprises a flat surface adjacent to the ski, wherein the flat surfaces enable the ski and the second ski to remain in close proximity during motion, wherein the ski further comprises a first semi-buoyant bumper coupled to the flat surface of the ski, wherein the second ski further comprises a second semi-buoyant bumper coupled to the flat surface of the second ski, and wherein the first semi-buoyant bumper and the second semi-buoyant bumper provide cushioning during motion of the ski and second ski.

2. A water craft system, comprising:

a ski configured to float on water and comprising a housing configured to receive a user's foot; and a propulsion device coupled to the ski and capable of floating on water, wherein the propulsion device is configured to grip the water and submerge a portion of the propulsion device in response to a force applied to the propulsion device in a direction approximately opposite a direction of motion of the water craft system and wherein the submerged portion of the propulsion device provides resistance for the user to propel the ski, the propulsion device comprising:

a semi-buoyant float comprising a surface configured to grip the water and submerge a portion of the float in response to a force applied to the float in a direction approximately opposite a direction of motion of the ski, and an arm coupled to the float for attaching the float to the ski.

3. The water craft system of claim 2, further comprising:

a second ski configured to float on water and comprising a second housing configured to receive the user's foot; and a second propulsion device coupled to the second ski and capable of floating on water, wherein the second propulsion device is configured to grip the water and submerge a portion of the second propulsion device in response to a force applied to the second propulsion device in a direction approximately opposite a direction of motion of the water craft system and wherein the submerged portion of the second propulsion device provides resistance for the user to propel the second ski.

4. The water craft system of claim 3, further comprising:

a first semi-elastic tether coupled to the ski and the second ski; and a second semi-elastic tether coupled to the ski and the second ski.

5. The water craft system of claim 4, wherein the first semi-elastic tether is coupled to the ski through a first drain hole at a front portion of the housing above a waterline of the ski and coupled to the second ski through a second drain hole at a front portion of the second housing above a waterline of the second ski, and wherein the second semi-elastic tether is coupled to the ski through a third drain hole at a rear portion of the housing above the waterline of the ski and coupled to the second ski through a fourth drain hole at a rear portion of the second housing above the waterline of the second ski.

6. The water craft system of claim 4, wherein the first and second semi-elastic tethers are adjustable to allow a distance between the ski and second ski to be increased or decreased.

7. The water craft system of claim 3, wherein the ski further comprises a flat surface adjacent to the second ski, wherein the second ski further comprises a flat surface adjacent to the ski, and wherein the flat surfaces enable the ski and the second ski to remain in close proximity during motion.

8. The water craft system of claim 3, wherein the ski further comprises:

first connectors coupled to the ski and the second ski for attaching a sail; and a second connector coupled to the ski or the second ski for attaching a rudder.

9. The water craft system of claim 8, further comprising:

a rudder coupled to the ski or the second ski for steering the water craft; and a sail coupled to the ski and the second ski for providing propulsion to the water craft system.

10. The water craft system of claim 2, wherein the ski further comprises a connector positioned at a rear portion of the ski and capable of receiving the arm, wherein the arm and connector enable the float to rotate about a transverse axis of the ski.

11. The water craft system of claim 10, wherein the ski further comprises a second connector positioned at a front portion of the ski and capable of receiving the arm.

12. The water craft system of claim 2, wherein the surface is substantially concave and is located at a rear portion of the float.

13. The water craft system of claim 2, further comprising:

at least one pole for use by the user of the craft, the at least one pole comprising:

a semi-buoyant float comprising a surface configured to grip the water and submerge a portion of the float in response to a force applied to the float in a direction approximately opposite a direction of motion of the water craft system, wherein the submerged portion of the float provides resistance for the user to propel the water craft system, and a handle coupled to the semi-buoyant float.

14. The water craft system of claim 13, wherein a length of the handle is adjustable.

15. The water craft system of claim 2, wherein the housing comprises:

a bottom surface positioned at a height below a top surface of the ski;

a raised platform coupled to the bottom surface;

a foot platform coupled to the raised platform at a front portion of the foot platform and configured to rotate parallel to an axis of the ski; and a semi-elastic member coupled to the housing and a rear portion of the foot platform, wherein the semi-elastic member provides tension as the foot platform rotates.

16. The water craft system of claim 2, wherein the ski further comprises:

a convex member located at an outside front portion of the ski; and a convex member located at an outside rear portion of the ski, wherein the convex members provide stability to the ski.

17. The water craft system of claim 2, wherein the ski further comprises a keel, wherein a bottom of the keel is substantially flat at a center portion of the ski and curves toward a top portion of the ski at a front portion and at a rear portion of the ski.

18. A water craft system, comprising:

a ski configured to float on water and comprising a housing configured to receive a user's foot, the housing comprising:

a raised trough including a drain for removing water from the housing, wherein the raised trough is positioned at a height between the top surface of the ski and the bottom surface; and a ramp coupled between the bottom surface and the raised trough for directing water into the raised trough in response to motion of the ski; and a propulsion device coupled to the ski and capable of floating on water, wherein the propulsion device is configured to grip the water and submerge a portion of the propulsion device in response to a force applied to the propulsion device in a direction approximately opposite a direction of motion of the water craft system and wherein the submerged portion of the propulsion device provides resistance for the user to propel the ski.

19. The water craft system of claim 18, wherein the housing further comprises:

a second raised trough including a drain for removing water from the housing, wherein the raised trough is positioned at a front portion of the housing and the second raised trough is positioned at a rear portion of the housing and wherein the second raised trough is positioned at a height between the top surface of the ski and the bottom surface; and a second ramp coupled between the bottom surface and the second raised trough for directing water into the second raised trough in response to motion of the ski.

20. The water craft system of claim 18, wherein the housing comprises;

at least one portal for providing access to an interior of the ski.

21. A propulsion system for propelling a craft in water, comprising:

a semi-buoyant float comprising a surface, wherein the surface is configured to grip the water and partially submerge the float in response to a force applied to the float in a direction approximately opposite a direction of motion of the craft and wherein the float provides resistance for a user to propel the craft; and a connector coupled to the float for attaching the float to the craft, wherein the connector enables the float to rotate about a transverse axis of the craft.

22. The propulsion device of claim 21, further comprising:

a second semi-buoyant float comprising a surface, wherein the surface is configured to grip the water and partially submerge the second semi-buoyant float in response to a force applied to the second semi-buoyant float in a direction approximately opposite a direction of motion of the craft and wherein the second semi-buoyant float provides resistance for the user to propel the craft; and a connector coupled to the second semi-buoyant float for attaching the second semi-buoyant float to a handle, wherein the handle enables the user of the craft to apply force to the second semi-buoyant float.

23. The propulsion device of claim 21, wherein the surface is concave and is located at a rear portion of the float.

24. A housing for receiving a user's foot, comprising:

a bottom surface positioned at a height below a top surface of the housing;

a raised platform coupled to the bottom surface;

a foot platform coupled to the raised platform at a front portion of the foot platform and configured to rotate perpendicular to a transverse axis of a ski; and a semi-elastic member coupled to the housing and a rear portion of the foot platform, wherein the semi-elastic member provides tension as the foot platform rotates.

25. The housing of claim 24, further comprising:

a raised trough including a drain for removing water from the housing, wherein the raised trough is positioned at a height between the top surface and the bottom surface; and a ramp coupled between the bottom surface and the raised trough for directing water into the trough in response to motion of the ski.

26. The housing of claim 25, further comprising:

a second raised trough including a drain for removing water from the housing, wherein the raised trough is positioned at a front portion of the housing and the second raised trough is positioned at a rear portion of the housing and wherein the second raised trough is positioned at a height between the top surface of the ski and the bottom surface; and a second ramp coupled between the bottom surface and the second raised trough for directing water into the second raised trough in response to motion of the ski.

* * * * *